US006959878B1

(12) United States Patent
O'Brien et al.

(10) Patent No.: US 6,959,878 B1
(45) Date of Patent: Nov. 1, 2005

(54) COMPACT FUEL INJECTION NOZZLE

(75) Inventors: Michael J. O'Brien, Glastonbury, CT (US); Robert W. Martin, Windsor, CT (US)

(73) Assignee: Stanadyne Corporation, Windsor, CT (US)

( * ) Notice: Subject to any disclaimer, the term of this patent is extended or adjusted under 35 U.S.C. 154(b) by 124 days.

(21) Appl. No.: 10/110,355

(22) PCT Filed: Nov. 17, 2000

(86) PCT No.: PCT/US00/31537

§ 371 (c)(1),
(2), (4) Date: Apr. 10, 2002

(87) PCT Pub. No.: WO01/36811

PCT Pub. Date: May 25, 2001

Related U.S. Application Data

(60) Provisional application No. 60/166,031, filed on Nov. 17, 1999.

(51) Int. Cl.[7] ..... F02D 1/06

(52) U.S. Cl. ..... 239/5; 239/533.3; 239/533.6; 239/533.9

(58) Field of Search ..... 239/533.2–533.12

(56) References Cited

U.S. PATENT DOCUMENTS

| | | | | | |
|---|---|---|---|---|---|
| 3,980,234 | A | * | 9/1976 | Bouwkamp | 239/533.11 |
| 4,163,521 | A | * | 8/1979 | Roosa | 239/86 |
| 4,200,231 | A | * | 4/1980 | Knape | 239/94 |
| 4,790,055 | A | * | 12/1988 | Raufeisen et al. | 29/888.46 |
| 5,110,054 | A | * | 5/1992 | Stevens | 239/533.11 |
| 5,647,540 | A | * | 7/1997 | Buckley | 239/533.2 |

* cited by examiner

*Primary Examiner*—Christopher Kim
(74) *Attorney, Agent, or Firm*—Alix, Yale & Ristas, LLP

(57) ABSTRACT

A compact fuel injection nozzle includes a unitary nozzle body, a nozzle cap, a valve member and a spring sub assembly. The spring sub assembly provides a biasing force against a valve member that includes an integral lift stop. The biasing force holds the nose of the valve member against the valve seat of the nozzle body until the fuel pressure inside the injector exceeds a minimum opening pressure. The lift stop provides a stop limit, permitting the valve member to move away from the valve seat a predetermined axial distance. The minimum opening pressure and valve opening axial distance may be calibrated by selection and installation of shims.

7 Claims, 7 Drawing Sheets

COMPACT FUEL INJECTION NOZZLE

This application is a National Stage Application under 371 of PCT/US00/31537 filed Nov. 17, 2000 which claims the benefit of U.S. Provisional Application 60/166,031 filed Nov. 17, 1999.

BACKGROUND OF THE INVENTION

This invention relates generally to a fuel injection nozzle. More particularly, the present invention relates to a fuel injection nozzle for an internal combustion engine.

Fuel injectors of the type contemplated by the present invention have a plunger or valve which is lifted from its seat by the pressure of fuel delivered to the injector by an associated high pressure pump in measured charges in timed relation with the associated engine. Representative fuel injector assemblies are described in U.S. Pat. Nos. 3,829,014, 4,205,789, 4,790,055, and 4,938,193.

The improvements in fuel injection nozzles chronicled by the succession of patents identified above, have been performance related and/or manufacturing related. In the present competitive market for these types of devices, the need to reduce the cost of materials and fabrication without compromising performance continues to be a primary factor. Although some of the devices represented by the prior art provided for improvements in materials and fabrication, further improvements are required.

Many internal combustion engines that utilize fuel injection nozzles are found in automotive applications. A fuel injection nozzle provides the path for injecting fuel into the combustion chamber of the internal combustion engine. Extensive analysis of the combustion process reveals that the most efficient injection point (in some cases) is at the top and center of the combustion chamber. In overhead cam engines the area immediately above the combustion chamber is occupied by the overhead cam (or cams) valve assemblies and connecting mechanisms, such as rocker arms, etc. Placement of injector nozzles in the midst of the valve train makes severe constraints on the length, diameter and overall size of the injector nozzle. Consequently, any reduction in size in the injector nozzle component provides improved flexibility of use.

Additionally, the tip of an injector nozzle includes discharge apertures from which pressurized fuel is delivered into the combustion chamber. Typically, the inside surface of the injector nozzle tip forms a valve seat for sealing with the injector valve between injection pulses. This valve seat/valve interface must form a reliable seal over a useful life that will encompass many millions of injection cycles. Materials for injection valves and injection nozzle tips therefore must be extremely tough, durable, i.e. hard materials. Injector nozzle tips are also subjected to high temperatures and pressures present in the combustion chamber. In high output or turbo-charged engines the temperature in the vicinity of the nozzle tip may well exceed 500° F. for sustained periods of time. Materials used for fuel injection valves and nozzle tips must therefore meet the dual requirements of maintaining their toughness over millions of cycles at sustained high temperatures. This has meant the use of specialty alloy steels having high Rockwell hardness and high temperature tempering properties.

Materials having these properties are typically both expensive and notoriously difficult to work with. The result has been that only the critical portions of the fuel injection nozzle were made from the exotic alloy steels, with the balance of the injector nozzle being more conventional steel.

Assembly of injector nozzles from multiple parts increases both the cost and complexity of the manufacturing process.

SUMMARY OF THE INVENTION

Accordingly, it is an object of the present invention to provide a fuel injection nozzle assembly in which the component parts are simply fabricated, easily assembled by automated processes, and readily installed in an engine, without compromising the performance of the nozzles.

Another object of the present invention is to provide a fuel injection nozzle assembly that has a compact size in relation to conventional fuel injection nozzle assemblies.

A further object of the present invention is to provide a fuel injection nozzle assembly in which the entire fuel injection nozzle body, including valve guide and nozzle tip, is made from a single piece of homogeneous material.

A yet further object of the invention is to provide a compact fuel injection nozzle assembly requiring fewer parts.

These objects are accomplished in accordance with the invention through improvements in several aspects of the conventional fuel injection nozzle assembly.

A fuel injection nozzle in accordance with the invention includes a one-piece integral nozzle member. The nozzle member has a lower portion that is mounted in a socket in the engine cylinder head such that the nozzle tip of the lower portion is positioned within the cylinder head. An upper portion of the nozzle member projects above the cylinder head. The nozzle member also includes an axial bore and a fuel inlet orifice intersecting the axial bore. The inside surface of the axial bore adjacent the nozzle tip defines a valve seat. A fuel inlet member has a fuel passage extending from an inlet end portion to an outlet end portion. The outlet end portion is affixed in fluid communication with the fuel inlet orifice of the nozzle member. The inlet end portion may be mounted directly to the fuel pump. A cap member has a lower portion mounted to the upper portion of the nozzle member.

A valve member received in the axial bore reciprocates in response to periodic pulses of pressurized fuel fed to the axial bore via the fuel inlet orifice. The valve is a one-piece member extending from a nose end configured to seal against the valve seat to an axially opposed lift stop. The valve member includes an actuating surface, a bearing surface and a spring seat.

An upper portion of the cap member and the upper portion of the nozzle member define a spring chamber. A spring subassembly disposed within the spring chamber includes a spring disposed around the lift stop and seated against the spring seat, a lift shim disposed adjacent the cap member, and an opening pressure shim disposed intermediate the lift shim and the nozzle member. The opening pressure shim has an axial opening. The upper end portion of the lift stop is received within the opening of the opening pressure shim. The upper end of the spring engages the opening pressure shim.

The minimum opening pressure and valve lift can be calibrated by installation of lift and opening pressure shims of different axial thicknesses. Measurements of injector nozzle components permit calculation of the correct shim thicknesses.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
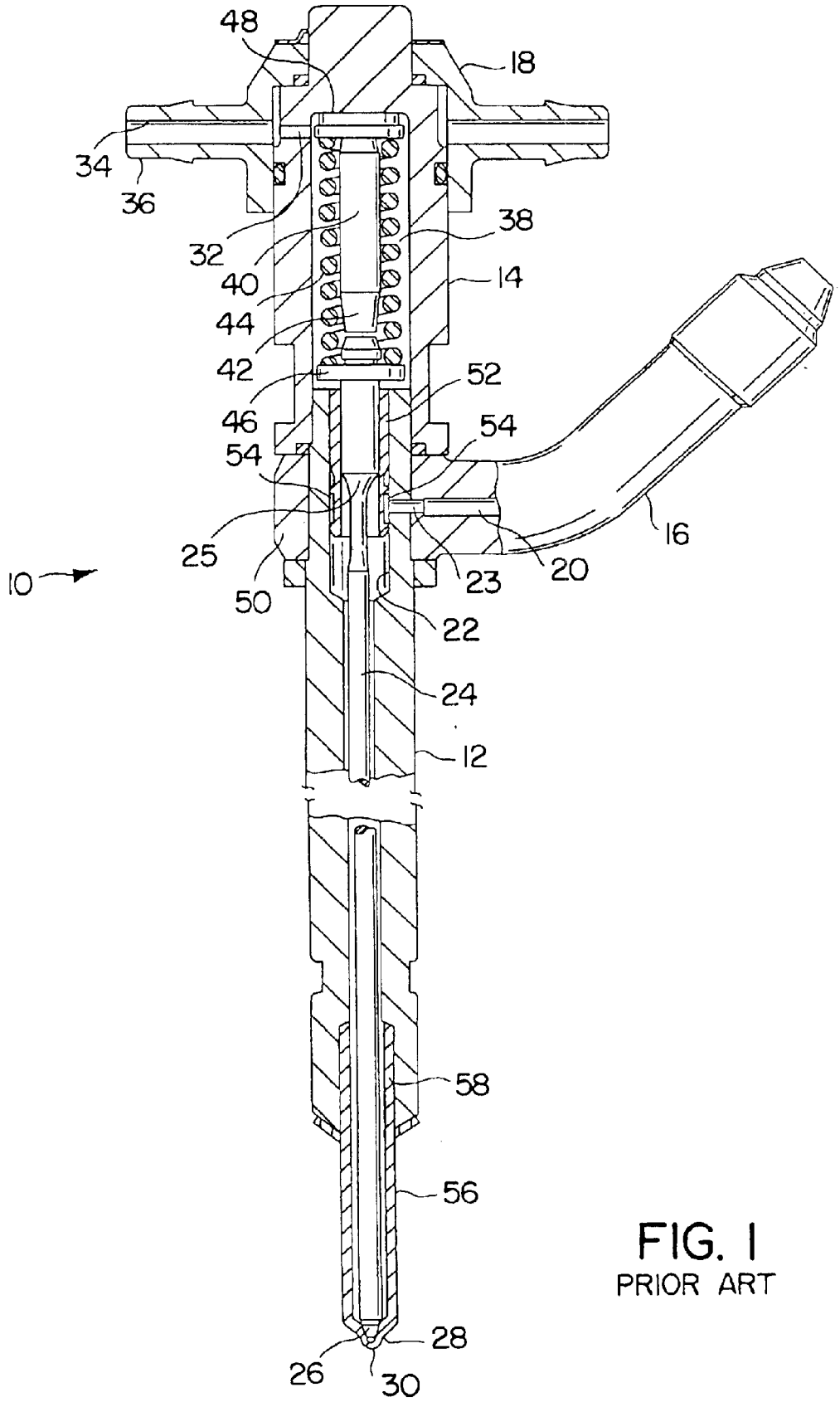
FIG. 1 PRIOR ART
FIG. 1 is an elevation view, partly in section, of a first prior art fuel injection nozzle.

FIG. 1 shows a first conventional fuel injection nozzle 10 having a nozzle body 12, a nozzle cap 14, a fuel inlet stud 16, and a leak-off cap 18. During operation, fuel is supplied through passages 20 in the fuel inlet stud 16, to a valve chamber 22 in the upper portion of the nozzle body 12. An elongated nozzle valve 24 is axially reciprocable within the nozzle body 12 and includes a conical nose 26 at its lower end for sealing against a valve seat 28 and intermittently providing flow through discharge apertures 30 in the nozzle tip. Fluid at low pressure exits the nozzle cap 18 through a channel 32 leading to channels 34 in the hydraulic connections 36 of the leak-off cap 18.

The primary function of the spring chamber 38 in the nozzle cap 14 is to properly position the spring subassembly 40. The spring subassembly 40 in the nozzle cap 14 includes a central lift stop 42, a coil compression spring 44 and spring seats 46, 48, arranged for biasing the valve 24 downwardly to close the valve and establish a minimum opening pressure. The spring seat 46 includes a generally disk-shaped base portion for contacting the upper end of the valve, and a pedestal portion projecting upwardly therefrom. The lift stop 42 includes a stem portion axially aligned with another spring seat 48 and an integral head portion which is received in abutting relation with the dome of the cap 14. The radially outer portions of the spring seats 46, 48 are adapted to engage the ends of the coil spring 44 and to hold it in a compressed (preloaded) condition within the spring chamber 38.

The fabrication of the prior art nozzle 10 begins with the transverse attachment of the inlet stud 16 to the nozzle body 12. The ring portion 50 has an inner diameter at ambient temperature that is smaller than the outer diameter of the nozzle body 12 portion to which it will be connected. The ring portion 50 is first heated to expand the inner diameter to a dimension greater than the outer diameter of the body portion. The ring 50 is then slipped over the body portion a predetermined distance relative to the upper end of the nozzle body 12. The ring 50 is cooled to form a rigid, shrink-fit, annular connection with the body portion, in such a manner to prevent leakage path formation. A drilling tool is then inserted into passage 20 and is advanced to penetrate the remaining material in the ring portion 50 and the adjacent wall of the nozzle body 12. The passage through the ring portion 50 into the chamber 22 is reamed, deburred and then burnished. The step of burnishing provides a fluid seal at the juncture of the second passage with the interface between the nozzle body exterior and the ring interior.

The outer, cylindrical mounting portion of the guide member 52 is machined to provide an appropriate interference fit against the wall of the valve chamber 22 upon insertion into the nozzle body 12. The forward, or downward portion of the guide member 52 includes a recessed, annular space 54 which, after insertion of the guide member 52 into the valve chamber 22, is in fluid communication with the passage 20 from the inlet stud 16. The two annular edges defining the recess 54 provide an "edge filter" effect such that fuel entering the recess 54 must pass over the edges in order to reach the valve chamber 22.

The next steps include: orienting and assembling the nozzle tip 56 into a press-fit and preferably staked relation with the tip cavity 58; measuring the dimensions of the interior of the guide member 52; selecting a valve 24 having a bearing surface of appropriate dimensions for proper diametrical clearance and inserting it into the nozzle bore; and assembling the spring subassembly 40.

Before the spring subassembly 40 is assembled and inserted into the spring chamber 38 of the cap 14, the critical dimensions are checked. In the case of a fuel injector, there are two primary critical dimensions. The first critical dimension is the "as assembled" distance between the upper end of the valve 24 and the dome of the cap 14. "As assembled" is the distance between these two points in an assembled injector. This distance can be determined from automated measurement of the nozzle body 12 with valve 24 inserted at one station, and measurement of the cap 14 and internal components thereof at another station. When this distance is known, the correct axial dimension (length) for the lift stop 42 can be determined. A lift stop 42 having the correct axial length will accurately permit the valve member to open a predetermined distance. The consistent accuracy of the valve opening distance is critical to the proper functioning of the injector.

The second critical dimension is the axial length of the spring 44 when the spring is preloaded (partially compressed) to a tension that will hold the valve 24 closed until the desired minimum opening pressure is exerted on the actuating surface 25 of the valve 24. The axial length of the preloaded spring is used to determine the correct axial dimension of the lift stop head, which in turn determines the axial position of the upper spring seat 48 with respect to the lower spring seat 46.

The head and the nose on the lift stop 42 are ground as necessary for adjusting the critical dimensions. After grinding, the spring subassembly 40 is inserted into the nozzle cap 14, which is then torqued onto the upper end of the nozzle body 12. A plastic or metal leak-off cap 18 is snapped on over the upper end of the nozzle cap 14. The leak-off cap 18 forms one or more annular recesses with the nozzle cap 14, leading to radial flow channels in fluid communication with the leak-off channel in the nozzle cap 14, whereby fluid at low pressure within the nozzle cap 14 can be diverted away and recycled if desirable.

Figure 2:
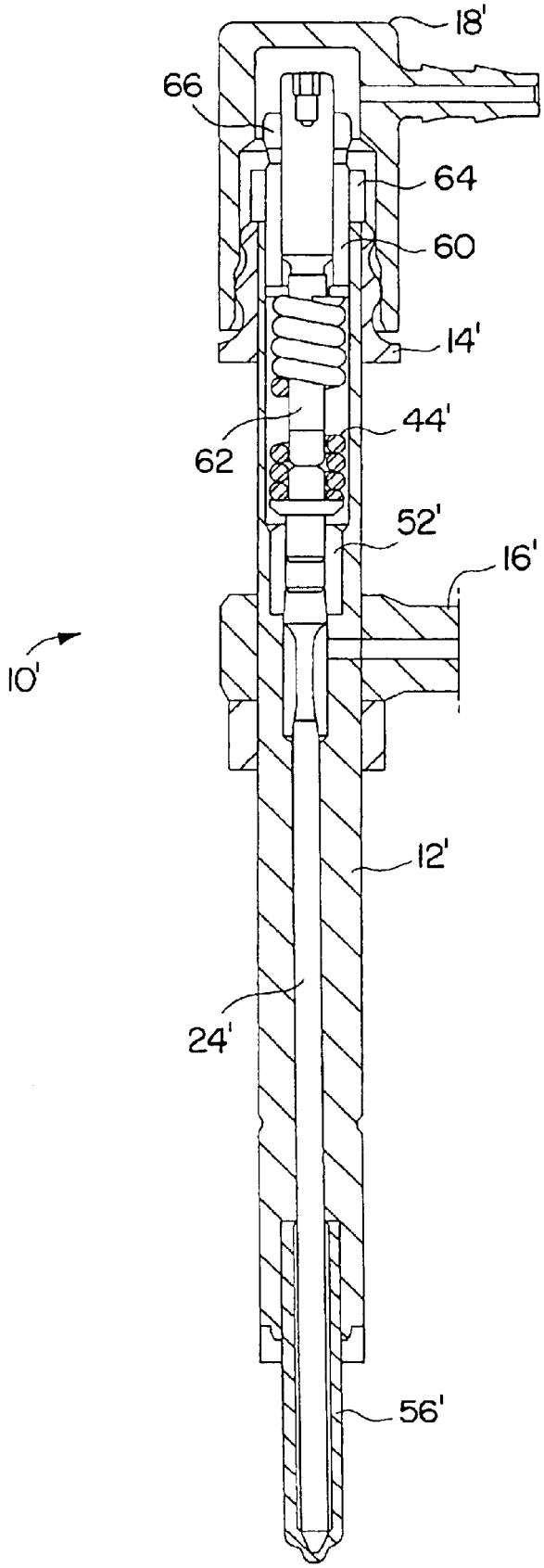
FIG. 2 PRIOR ART
FIG. 2 is an elevation view, partly in section, of a second prior art fuel injection nozzle.

In the second prior art fuel injection nozzle 10' shown in FIG. 2, the critical dimensions may be threadably adjusted by the pressure screw 60 and the lift screw 62. After the critical dimensions are set, the pressure screw 60 and lift screw 62 may be locked in place by a pressure locknut 64 and a lift locknut 66, respectively.

These prior art assembly configurations and methods of assembly require many precision parts and the intervention of skilled personnel in the assembly process. Such skilled personnel add to the cost of producing a fuel injection nozzle. In addition, human intervention in the production process may produce variable results depending upon the skill and/or attentiveness of the individual. As can be seen from FIGS. 1 and 2, the prior art injector nozzle bodies 12 and 12' required the insertion of a separate nozzle tip 56 and guide member 52. A compact fuel injection nozzle as described below incorporates the nozzle tip and guide member into a unitary injector nozzle body and permits adjustment of critical dimensions by the selection of appropriately dimensioned shims. A compact fuel injection nozzle in accordance with the present invention can be assembled more efficiently and with less human intervention than prior art fuel injection nozzles. Ultimately, a compact fuel injection nozzle may be assembled in a fully automated process.

Figure 3:
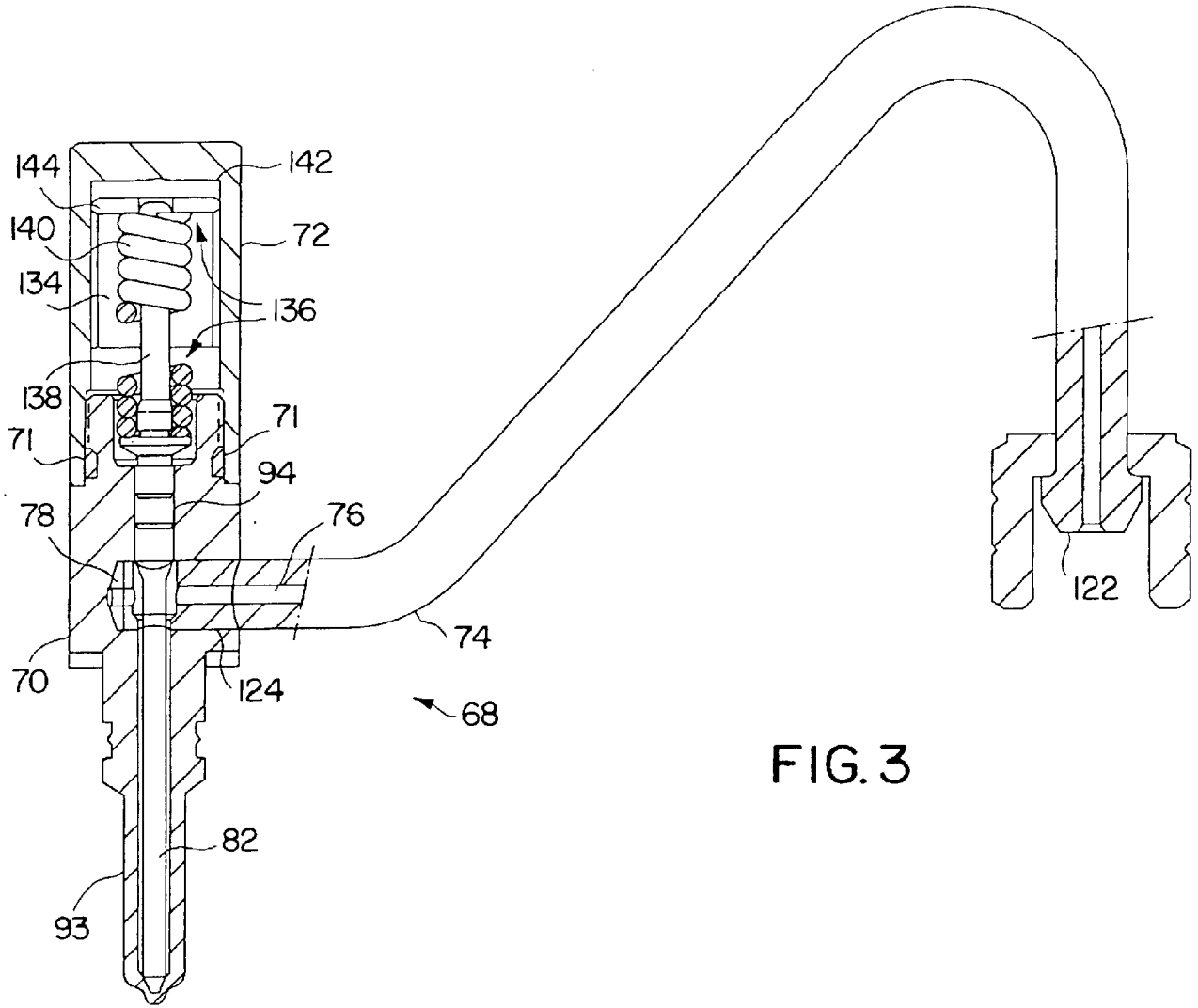
FIG. 3 is an elevation view, partly in section, of a compact fuel injection nozzle in accordance with the present invention.
Figure 4:
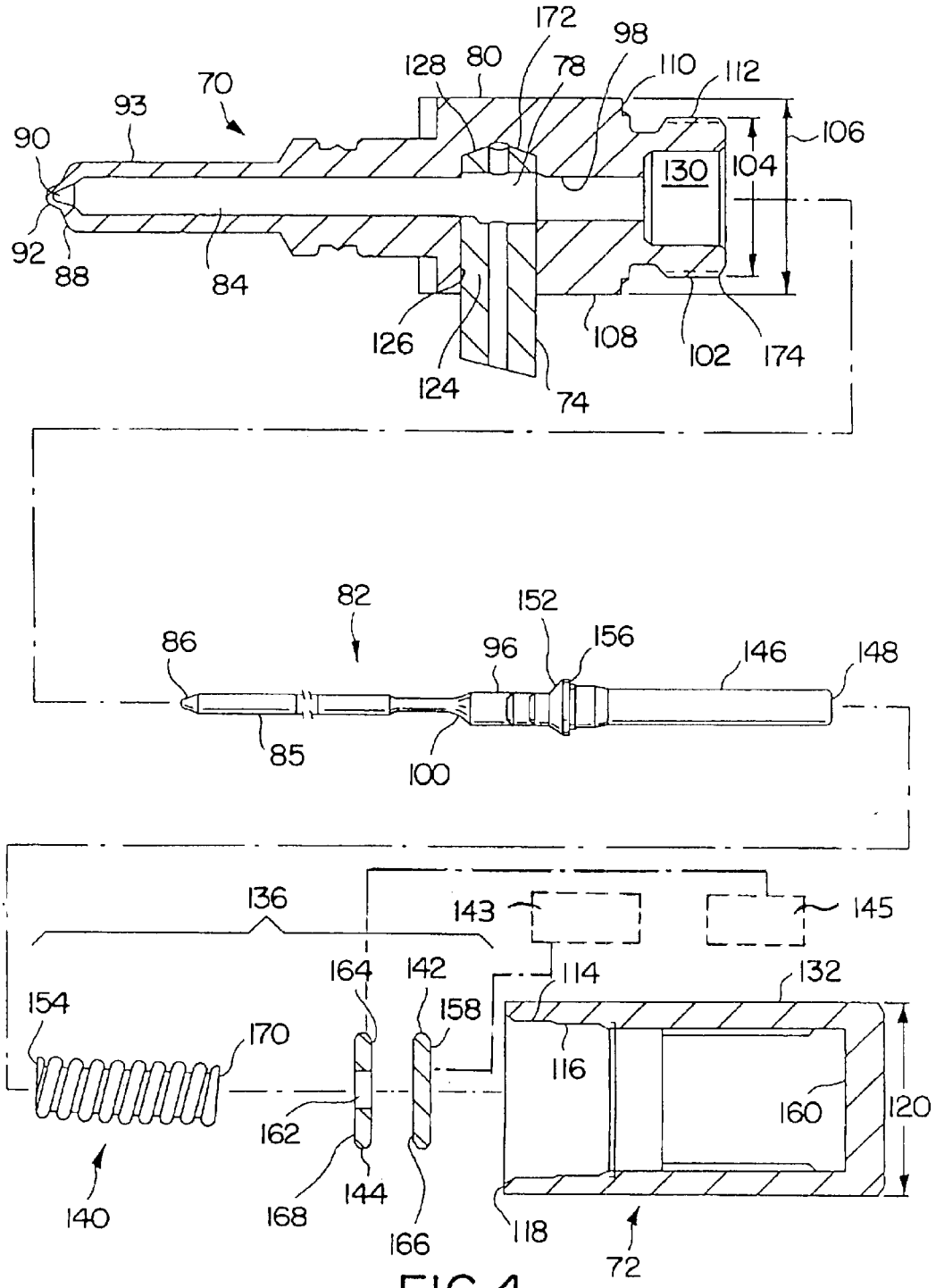
FIG. 4 is an exploded view, partly in section, of the nozzle of FIG. 3, more clearly illustrating the individual components and the manner in which the components are assembled.

With reference to FIGS. 3 and 4, wherein like numerals represent like parts throughout the figures, a compact fuel injection nozzle in accordance with the present invention is generally designated by the numeral 68. The compact fuel injection nozzle 68 includes a nozzle body 70, a valve member 82, a spring subassembly, a nozzle cap 72, and a fuel inlet 74. Fuel is supplied through a passage 76 in the fuel inlet 74, to a valve chamber 78 in the upper portion 80 of the nozzle body 70. An elongated nozzle valve 82 axially reciprocates within an axial bore 84 in the nozzle body 70 such that a conical nose 86 at its lower end seals against a valve seat 88, intermittently providing flow through discharge apertures 90 in the nozzle tip 92.

A lower portion 93 of the nozzle body 70 is mounted within a socket in an engine cylinder head (not shown) such that the upper portion 80 of the nozzle body 70 projects outwardly from the cylinder head and the intermittent flow of fuel is discharged into the cylinder. Pressurized fuel is forced (leaks) into the gap 94 between the bearing surface 96 of the nozzle valve 82 and the inside surface 98 of the axial bore 84 and provides lubrication between the nozzle valve 82 and the nozzle body 70. The valve 82 is reciprocated as a result of the intermittent fuel pulses entering the valve chamber 78, which apply hydraulic pressure on the actuating surface 100 of the valve 82. Hydraulic pressure from fuel pulses lift the valve nose 86 off the valve seat 88, exposing the discharge apertures 90 to the high pressure fuel occupying the axial bore 84 of the nozzle body 70. Fuel under high pressure is then forced through discharge apertures 90 into the cylinder for combustion.

An upper segment 102 of the upper portion 80 of the nozzle body 70 has an outside diameter 104 that is less than the outside diameter 106 of the lower segment 108 of upper portion 80, forming an upwardly facing shoulder 110. The outside surface of upper segment 102 has a thread surface 112. The inner surface of the lower portion 114 of the nozzle cap 72 has a thread surface 116 that is complementary with the thread surface 112 on upper segment 102. When the nozzle cap 72 is installed on the nozzle body 70, the lip 118 of the nozzle cap 72 engages the shoulder 110 on the nozzle body 70. The threaded engagement between the lower portion 114 of the nozzle cap 72 and the upper segment 102 of the nozzle body 70, together with a compressed annular gasket or O-ring 71 provide a substantially leak-tight seal. Preferably, the outside diameter 120 of the nozzle cap 72 is substantially equal to the outside diameter 106 of the upper portion 80 of the nozzle body 70 such that the outside surface of the assembled fuel nozzle 68 has a uniform appearance.

With reference to the embodiment of the compact fuel injection nozzle illustrated in FIGS. 3 and 4, the fuel inlet 74 is a single unitary pipe-like or tube-like structure having an inlet end portion 122 removably mounted to a fuel pump (not shown) and an outlet end portion 124 which is fixedly mounted to the nozzle body 70. In this embodiment, the outlet end portion 124 of the fuel inlet 74 is disposed within a transverse bore 126 which extends from the outer surface of the nozzle body 70 to an abutment face 128 positioned such that transverse bore 126 intersects valve chamber 78. A fuel passage 76 provides fluid communication between the fuel pump and the valve chamber 78. The transverse bore 126 may extend through the valve chamber 78 such that the abutment face 128 is positioned in the opposite wall, as shown in FIG. 3. Alternatively, the abutment face 128 may be positioned at a point intermediate the outer edge of the valve chamber 78 and the mid-point of the valve chamber 78.

A valve member 82 extends from a nose end 86 to the head 148 of the integral lift stop 138. A stem 85 connects the nose end 86 to the actuating surface 100, bearing surface 96 and spring seat 156 machined on the length of the valve member 82. The valve member 82 is received in the axial bore of the nozzle body 70 with the nose end adjacent the valve seat 88. The bearing surface 96 is closely received by the valve guide surface 98 so the valve member is supported for axial movement.

The upper segment 102 of the nozzle body 70 forms a cavity 130, which, together with the upper portion 132 of the nozzle cap 72, define a spring chamber 134. A spring subassembly 136 housed in the spring chamber 134 includes a coil compression spring 140, a lift shim 142, and an opening pressure shim 144, arranged for biasing the valve 82 downwardly to close the valve and establish a minimum opening pressure. The spring 140 surrounds the lift stop 138 with the lower end 154 of the spring 140 bearing against the spring seat 156 of the valve member 82. The disc-shaped lift shim 142 has a top surface 158 that abuts the inside surface 160 of the dome of the cap 72. The washer-shaped opening pressure shim 144 has an axial opening 162 sized to slidably receive the head end 148 of the lift stop 138. The pressure shim 144 has an upper surface 164 which abuts the bottom surface 166 of the lift shim 142 and a lower surface 168 which engages the upper end 170 of spring 140.

Figure 5:
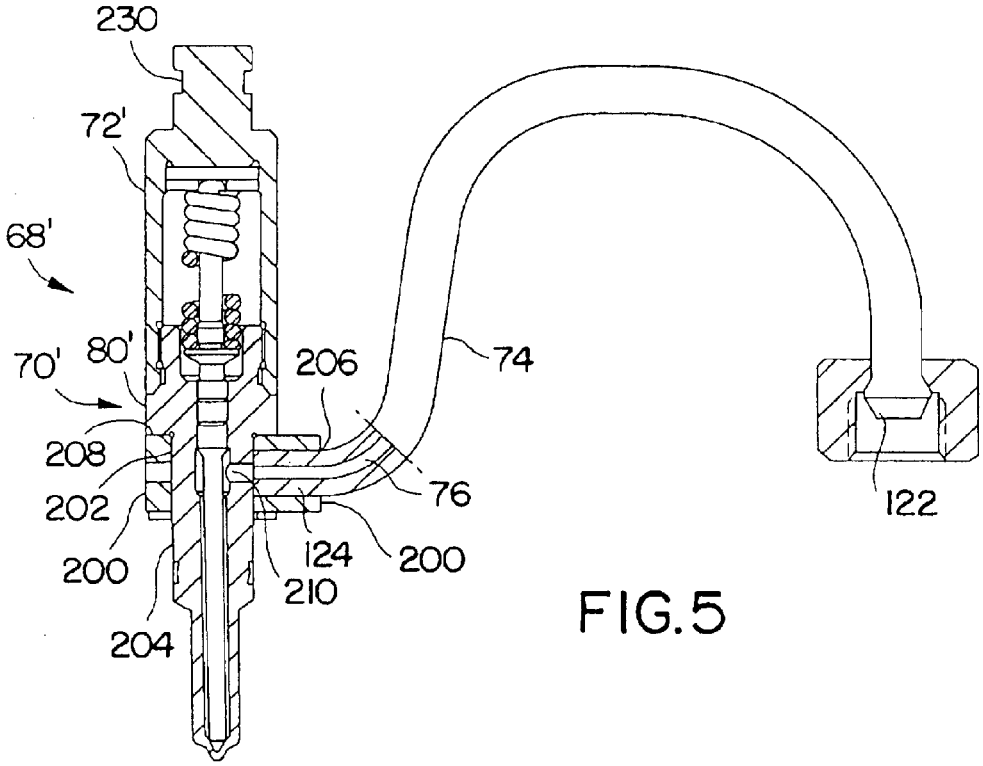
FIG. 5 is an elevation view, partly in section of a second embodiment of a compact fuel injection nozzle in accordance with the present invention.
Figure 6:
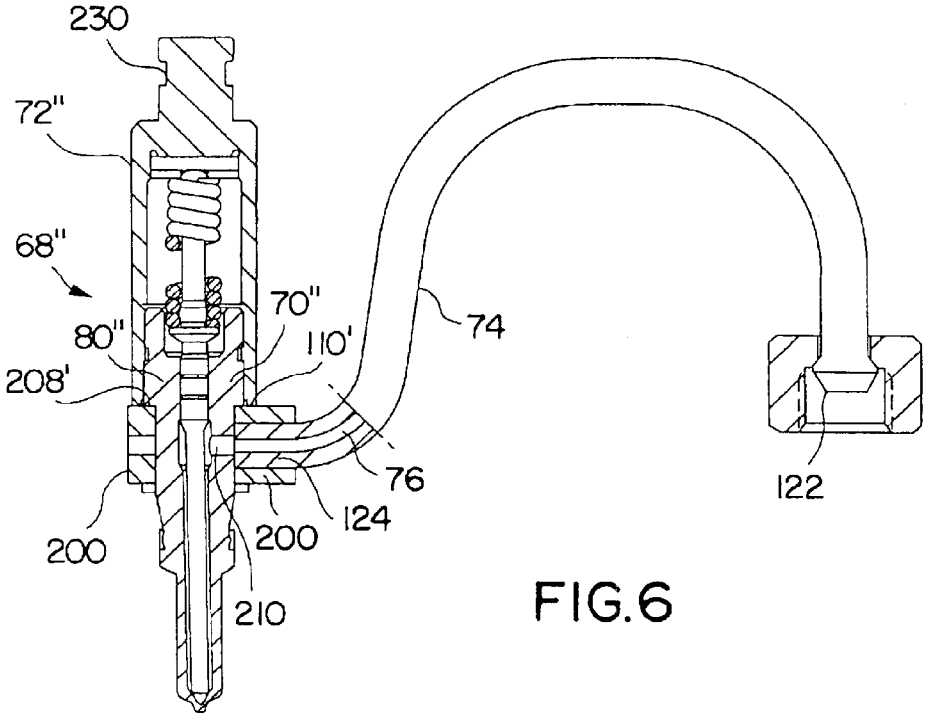
FIG. 6 is an elevation view, partly in section of a third embodiment of a compact fuel injection nozzle in accordance with the present invention.

FIGS. 5 and 6 illustrate alternative preferred embodiments of the compact fuel injection nozzle 68' and 68". With reference to FIG. 5, alternative embodiment 68' incorporates an alternative configuration for attaching the fuel inlet member 74 to the nozzle body 70. The middle segment 204 of the nozzle body 70' has a diameter that is less than the upper portion 80 of the nozzle body, forming a downwardly facing shoulder 208. A banjo-type fitting 200 includes an opening 202 to receive the middle portion 204 of the nozzle body 70 and an opening 206 orthogonal to the nozzle body to receive the outlet end portion 124 of the fuel inlet member 74.

The fitting 200 is preferably brazed to the outlet end portion 124 of the inlet member 74. The fitting 200 is then mounted to the nozzle body 70' with the fitting abutting the downward facing shoulder 208. The axial location of the shoulder 208 and the configuration of the fitting 200 serve to axially align the fuel passage 76 of the fuel inlet member 74 with the fuel inlet 210 in the injector nozzle 70'. Angular alignment of the fuel passage 76 and the fuel inlet 210 may be accomplished by any number of known methods. The fitting 200 is then preferably brazed to the nozzle body 70 to form a durable, sealed joint.

FIG. 6 illustrates a further preferred embodiment 68" in which the outer diameter of the upper portion 80" of the nozzle body 70" is reduced, resulting in a narrowed downward facing shoulder 208'. The fitting 200 is assembled to the nozzle body 70" and the outlet end portion 124 of the fuel inlet 74 in the same manner as described with respect to embodiment 68'. Fitting 200 extends radially beyond the narrowed downward facing shoulder 208', forming an upward facing shoulder 110'. The configuration of the cap 72" is altered to abut the new, lower upward facing shoulder 110' when assembled. This alternative embodiment 68" results in the use of less tool steel to form the nozzle body 72", further reducing the cost of production.

In all respects other than those described, alternative embodiments 68' and 68" are configured and function substantially the same as embodiment 68.

It will be noted that the cap 72', 72" of the compact fuel injection nozzle 68', 68" includes an external annular groove 230. This groove 230 is used to facilitate removal of the fuel injection nozzle 68', 68" from the cylinder head of an engine (not illustrated) as explained in U.S. Pat. No. 4,790,055.

The nozzle body 70 is preferably manufactured from a single, unitary piece of M50 tool steel that can be heat-treated to a hardness of Rockwell C 60–C 64. The term "unitary" as used in this application refers to a single piece of homogeneous material, in this case M50 alloy tool steel. Of course, other alloy steels or materials may be appropriate. When purchased as bar stock, the M50 tool steel is of moderate hardness (approximately Rockwell C 20–25) and is readily machinable using standard machining methods. From bar stock, a nozzle body 70 is machined to include the required external dimensions, cavity 130 and a rough axial bore 84. An appropriate transverse bore 126, or fuel inlet orifice 210 is machined to intersect with axial bore 84.

Assembly of the nozzle 68 begins with the transverse attachment of the fuel inlet 74 to the nozzle body 70. The outlet end portion 124 of the fuel inlet 74 is inserted into the transverse bore 126 until the outlet end 172 engages the abutment face 128. The outside surface of the fuel inlet 74 is brazed to the outside surface of the nozzle body 70 to fixedly mount the fuel inlet 74 to the nozzle body 70 and to prove a fluid-tight seal between the fuel inlet 74 and the nozzle body 70.

Assembly of alternative embodiments 68', 68" begins with attachment of the fitting 200 (containing the outlet end portion 124 of the fuel inlet 74) to the nozzle body 70', 70". Preferably the fitting is brazed in place to provide a strong, fluid tight bond between the fitting 200 and the nozzle body 70', 70".

For all embodiments 68, 68', 68", the brazing process takes place in a furnace where the assembled nozzle body 70, 70', 70", fitting 200 (if appropriate) and fuel inlet 74 are heated to a temperature of approximately 2,100° F. Copper material, inserted between the parts during assembly, melts in the heat and flows to form the brazed joint. The alloy steel of the nozzle body 70, 70', 70" is hardened by the cycle of heating and cooling experienced in the furnace. The alloy steel, which was formerly Rockwell C ($R_c$) 20–25, is hardened to a Rockwell C ($R_c$) 60–64. The alloy steel nozzle body is then tempered at a temperature of approximately 1,100° F. to relieve internal stresses in the crystal structure that occur during the brazing/hardening process, as is known in the art.

The next step is to use an Electrical Discharge Machine to produce the fine discharge apertures 90 in the now hardened and tempered nozzle tip 92. Precise grinding tools are then used to hone the valve guide surface 98 of the axial bore 84 where the bore will guide the axial movement of the nozzle valve 82. The bore 84 in this location must be very precisely configured so the gap 94 between the bearing surface 96 of the valve 82 and the valve guide surface 98 meets strict tolerances. The valve seat 88 is also ground to a specified configuration. Cutting lubricant may be injected into the axial bore 84 through the discharge apertures 90 in the tip as well as from the direction of the honing/lapping tool (not illustrated) to cool and lubricate the honing/lapping tools. The lubricant is injected at high pressure to ensure adequate cooling and eject any removed material. The shortened length of the axial bore 84 in the compact fuel injection nozzle decreases the length of the lapping tool used to configure the valve seat 88. A shorter tool has increased rigidity at its grinding tip, resulting in acceptable accuracy in the valve seat configuration.

Assembly of the internal parts of the compact fuel injection nozzle in accordance with the present invention will be described with reference to the embodiment illustrated in FIGS. 3 and 4. It will be understood by those of skill in this art that the methods described with reference to embodiment 68 are equally applicable to alternative embodiments 68' and 68".

Next, a nozzle valve 82 having a bearing surface 96 of appropriate dimensions for proper diametrical clearance (as described above) is inserted into the axial bore 84 and the distance between the head end 148 of lift stop 138 and a reference point 174 on the valve body 70 is measured. The relative position of the spring seat 156 with respect to reference point 174 is also measured. It will be understood by those of ordinary skill in the art that reference point 174 is arbitrary. All that is important about the reference point is that the same point be used consistently.

A lift shim 142 having a thickness determined by the measured distance between head end 148 and reference point 174 is selected from a family of lift shims 143. The family of lift shims 143 comprises a number of lift shims having different predetermined thicknesses. The number of lift shims and the thickness of each lift shim in the family 143 are selected such that the selected lift shim 142 substantially corrects the accumulated tolerances for the spring subassembly components without requiring the machining of any such components. Selecting an appropriate lift shim 142 from a family of lift shims 143 thereby eliminates one or more machining steps that were required to manufacture the first prior art nozzle 10. In addition, selecting an appropriate lift shim 142 from a family of lift shims 143 thereby eliminates the lift locknut 66 and pressure locknut 64 required to manufacture the second prior art nozzle 10'.

Figure 7:
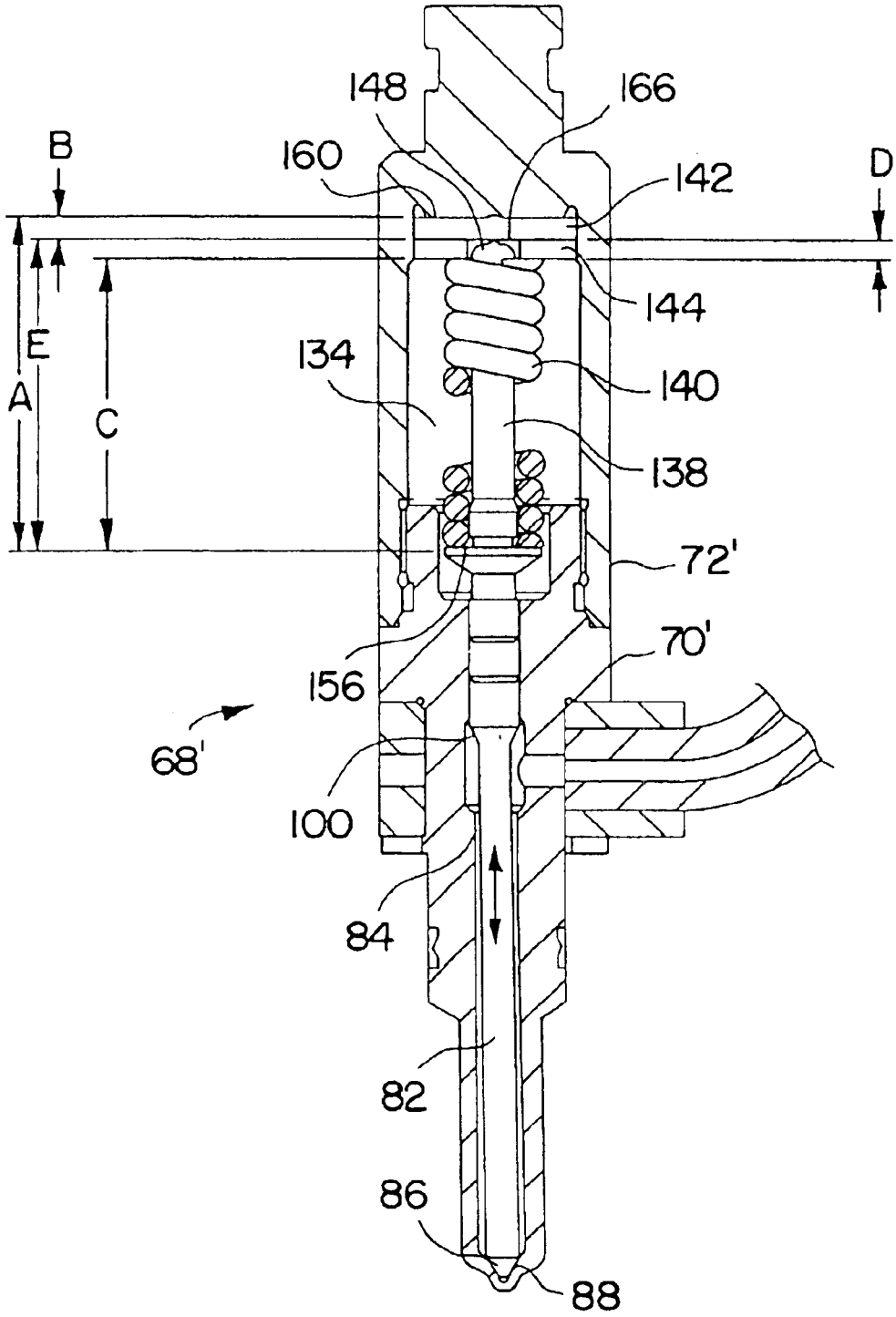
FIG. 7 is an enlarged elevation view of the compact fuel injection nozzle illustrated in FIG. 5.

The relationships between the parts contained in the spring chamber 134 are best illustrated with reference to FIG. 7. A compact fuel injection nozzle 68' is configured so that the valve member 82 moves axially away from the valve seat 88 by a predetermined valve lift distance in response to a predetermined fuel pressure (minimum opening pressure) in the axial bore 84. The opening distance and the minimum opening pressure are determined by the components in the spring chamber 134 acting on the valve member 82.

An assembled cap 72' and nozzle body 70' have a fixed relationship to one another, resulting in a fixed distance from the valve seat 88 to the inside surface 160 of the cap 72". To establish the opening distance of the valve member 82, the position of the head end 148 of a seated valve member 82 is measured with respect to some part of the nozzle body 70'. The "as assembled" relationship of the inside surface 160 of the cap 72' relative to the part of the nozzle body are known and permit the calculation of the distance between the head end 148 of the valve member 82 and the inside surface 160 of the cap (shown in FIG. 7 as B). Distance B minus the axial thickness of lift shim 142 equals the valve lift distance. The valve lift distance may be adjusted by selection of lift shims from a family of lift shims having various axial thicknesses.

When the appropriate lift shim 142 has been selected, distance E between the bottom surface 166 of the lift shim 142 and the spring seat 156 of the valve member 82 can be calculated. The axial length of a correctly preloaded spring is preferably determined by bench testing. Knowing the axial length of the preloaded spring 140 and distance E, the axial thickness D of opening pressure shim 144 can be determined and the appropriate opening pressure shim selected from a family of opening pressure shims 145 having various axial thicknesses.

Thus, by simple and reliable bench measurements, it is possible to match a lift shim 142 and opening pressure shim 144 to a given nozzle body 70', valve member 82, cap 72' and spring 140. A matched set of parts will accurately produce the desired opening distance and opening pressure in the assembled compact fuel injection nozzle 68'. This manufacturing process requires no grinding or intervention by highly skilled personnel to achieve consistently acceptable quality.

It should be appreciated that a compact fuel injection nozzle 68, 68', 68" in accordance with the invention replaces the nozzle body 12, 12', nozzle tip 56, 56' and guide member 52, 52' of the prior art nozzles 10, 10' with a single, unitary nozzle body 70, 70', 70". This eliminates the manufacturing steps required to manufacture each of the three components separately, measuring the guide member 52, 52' and nozzle tip 56, 56' for fit with the nozzle body 12, 12', and press-fitting and staking the guide member 52, 52' and nozzle tip 56, 56' to the nozzle body 12, 12'. The use of three separate components to form a complete prior art nozzle body was necessitated by limitations within the prior art manufacturing process.

The nozzle tip 56, 56' and guide member 52, 52' must be composed of a relatively hard metal to provide the proper operating characteristics. The prior art machining process could not machine the axial bore if the valve body 12, 12' was composed of the same material as the nozzle tip 56, 56' and guide member 52, 52'. Consequently, the nozzle body 12, 12' of prior art nozzles 10, 10' is composed of carbon steel. The manufacturing process which has been developed to produce the compact fuel injection nozzle 68 utilizes coolant at a higher pressure (up to 2000 psi) in a manner which had not been envisioned before. The subject manufacturing equipment and process directs a stream of this high pressure coolant into the nozzle body 70 as the axial bore 84 is machined to cool the work area, provide lubrication, and to eject chips out of the work area. As a consequence, an accurate axial bore 84 and valve seat 88 can be ground in the hard material, allowing the entire nozzle body 70 to be manufactured from the same material as a unitary member. In addition, the manufacturing process can manufacture the components to tighter tolerances.

The overall length of the compact injection nozzle 68, 68', 68" is only 3.00 inches as compared to an overall length of 4.00 inches for the prior art nozzles. The tip shank minimum diameter of the compact injection nozzle is slightly greater (0.220 inches) than that of the prior art nozzles (0.214 inches) and the injector minimum shank diameter is substantially the same as that of the prior art nozzles (0.374 inches). It should be appreciated that the reduced length of the compact nozzle provides increased flexibility of use. It should also be appreciated that the small difference in the tip shank minimum diameter has substantially no impact on the use of the compact injection nozzle 68.

Prior art nozzles 10, 10' require a leak-off path to allow the nozzles to be properly tuned in a cost-effective manner. The use of tighter tolerances in conjunction with a fuel injection pump assembly that permits pressures in the fuel inlet 74 to bleed down between injection cycles has eliminated the need to provide a fuel leak-off path. Consequently, the leak-off cap 18, 18' of the prior art nozzles 10, 10' has been eliminated. This feature is particularly advantageous when the injector nozzle is located in the midst of the valve train, because several possible sources of fuel leaks are eliminated.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A fuel injection nozzle assembly for providing fluid communication between a fuel pump and an engine including a cylinder and a cylinder head having a socket, the nozzle assembly comprising:

a unitary nozzle member having a lower portion for mounting in the socket and an upper portion for projecting above the cylinder head, the lower portion terminating in a nozzle tip for insertion into the cylinder, the nozzle member defining an axial bore and a fuel inlet orifice intersecting the axial bore, an inside surface of said axial bore adjacent said nozzle tip defining a valve seat;

a fuel inlet member defining a fuel passage and having oppositely disposed inlet and outlet end portions, the outlet end portion being affixed in fluid communication with said fuel inlet orifice, the inlet end portion being mountable to the fuel pump;

a cap member having upper and lower portions, the lower portion of the cap member being mounted to the upper portion of the nozzle member, the upper portion of the cap member and the upper portion of the nozzle member defining a spring chamber;

a unitary valve member disposed to axially reciprocate within the axial bore of the nozzle member, the valve member having oppositely disposed nose end and head ends, the nose end being disposed adjacent said nozzle tip, and including an integral spring seat and axially extending lift stop terminating at said head end; and a spring subassembly disposed within the spring chamber, the spring subassembly including a spring disposed around the lift stop, at least one lift shim having an axial thickness (B) disposed adjacent the cap member, and an opening pressure shim disposed intermediate the lift shim and the nozzle member, the opening pressure shim defining an axial opening, the head end of the lift stop being received within an axial opening of the opening pressure shim, the spring being compressively engaged between the opening pressure shim and the spring seat, wherein said valve member reciprocates a first axial distance between a closed position in which said nose end is in close contact with said valve seat and an open position in which said head end is in contact with said lift shim, said first axial distance being adjustable by selection and mounting of said at least one lift shim from a family of lift shims having axial thicknesses (B), said valve member moving axially away from said valve seat in response to a minimum opening pressure exerted on an actuating surface of said valve member by a charge of pressurized fuel in said axial bore and said minimum opening pressure is adjustable by selection and mounting of at least one opening pressure shim having an axial thickness (D) from a family of opening pressure shims, the axial thickness (D) of said at least one opening pressure shim being at least partially dependent upon the axial thickness (B) of the at least one lift shim.

2. The fuel injection nozzle of claim 1, wherein said family of lift shims comprises at least two lift shims having different axial thicknesses (B).

3. The fuel injection nozzle assembly of claim 1, wherein said family of opening pressure shims comprises at least two opening pressure shims having different axial thicknesses (D).

4. The fuel injection nozzle assembly of claim 1, wherein said nozzle body consists essentially of alloy tool steel.

5. A method for manufacturing a compact fuel injection nozzle assembly having an elongated, generally cylindrical spring chamber at one end and an axial bore extending from the spring chamber to a nozzle tip including an inside surface defining a valve seat, said manufacturing method comprising the steps of:

mounting a fuel inlet member to a nozzle member with a fuel passage defined by said nozzle member in fluid communication with a fuel inlet orifice in said nozzle member;

inserting a valve member having an integral lift stop axially extending from a spring seat to a head end into the axial passage until the nose end contacts the valve seat and the head end is disposed in the spring chamber upper portion;

selecting a nozzle cap comprising means for rigidly securing the nozzle cap to the nozzle member and defining an upper inside surface, wherein the distance between the upper inside surface of a rigidly mounted nozzle cap and a reference point on said nozzle member is known;

measuring the position of the head end relative to the reference point on said nozzle member;

measuring the position of the spring seat relative to the reference point on said nozzle member;

calculating the positions of said head end and spring seat relative to the inside surface of a rigidly mounted nozzle cap;

measuring the compressed length of a spring for providing a desired downward biasing force against the valve;

calculating an axial thickness of a lift shim where the lift shim axial thickness (B) equals the distance between the head end and the cap member upper inside surface minus a desired axial gap;

selecting a lift shim having said calculated axial thickness (B);

installing said lift shim within said cap member so that said lift shim abuts said cap member upper inside surface;

calculating an axial thickness of an opening pressure shim where the opening pressure shim axial thickness (D) equals the distance between the spring seat and the cap member upper inside surface minus the sum of the compressed length of the spring and the axial thickness (B) of the lift shim;

selecting an opening pressure shim having said calculated axial thickness (D);

installing said opening pressure shim in said cap member so that said opening pressure shim abuts said lift shim;

installing the spring over said lift stop; and rigidly securing said cap member to said nozzle member with said spring engaged between said opening pressure shim and said spring seat, wherein said axial thickness (B) of said lift shim and said axial thickness (D) of said opening pressure shim affect an opening pressure at which said valve member moves away from said valve seat in response to pressurized fluid in said axial passage.

6. The manufacturing method of claim 5, wherein said axial gap is inversely proportional to the lift shim axial thickness (B).

7. The manufacturing method of claim 5, wherein said desired downward bias is directly proportional to the sum of said lift shim axial and opening pressure shim axial thicknesses (B, D).

* * * * *